US010895045B2

(12) United States Patent
Kangas

(10) Patent No.: US 10,895,045 B2
(45) Date of Patent: Jan. 19, 2021

(54) CONCRETE SCREEDING MACHINE WITH COLUMN BLOCK CONTROL USING GYRO SENSOR

(71) Applicant: Somero Enterprises, Inc., Ft. Myers, FL (US)

(72) Inventor: Matthew A. Kangas, Atlantic Mine, MI (US)

(73) Assignee: SOMERO ENTERPRISES, INC., Ft. Myers, FL (US)

( * ) Notice: Subject to any disclaimer, the term of this patent is extended or adjusted under 35 U.S.C. 154(b) by 50 days.

(21) Appl. No.: 16/223,295

(22) Filed: Dec. 18, 2018

(65) Prior Publication Data

US 2019/0186083 A1 Jun. 20, 2019

Related U.S. Application Data

(60) Provisional application No. 62/599,809, filed on Dec. 18, 2017.

(51) Int. Cl.

| | |
|---|---|
| ***E01C 19/22*** | (2006.01) |
| ***E01C 19/00*** | (2006.01) |
| ***E04F 21/24*** | (2006.01) |
| ***E01C 19/40*** | (2006.01) |

(52) U.S. Cl.
CPC ..... *E01C 19/004* (2013.01); *E01C 19/40* (2013.01); *E04F 21/242* (2013.01)

(58) Field of Classification Search
CPC ..... E01C 19/006; E01C 19/40
See application file for complete search history.

(56) References Cited

U.S. PATENT DOCUMENTS

| | | | |
|---|---|---|---|
| 2,796,685 | A | 6/1957 | Bensinger |
| 3,604,325 | A | 9/1971 | Borges |
| 3,870,427 | A | 3/1975 | Allen |
| RE28,400 | E | 4/1975 | Burgin |
| 3,953,145 | A | 4/1976 | Teach |
| 4,655,633 | A | 4/1987 | Somero et al. |
| 4,759,657 | A | 7/1988 | Dorr et al. |
| 4,807,131 | A | 2/1989 | Clegg |

(Continued)

OTHER PUBLICATIONS

International Search Report and Written Opinion dated Mar. 8, 2019 for corresponding PCT Application No. PCT/US2018/066142.

*Primary Examiner* — Thomas B Will
*Assistant Examiner* — Katherine J Chu
(74) *Attorney, Agent, or Firm* — Honigman LLP

(57) ABSTRACT

A screeding machine for screeding an uncured concrete surface includes a screed head assembly movable over the concrete surface via the screeding machine. A pair of elevation sensors disposed at opposite ends of the screed head assembly sense an elevation of the respective end of the screed head assembly. An angle sensor disposed at the screed head assembly senses a pitch angle and/or a roll angle of the screed head assembly. A gyroscope sensor disposed at the screed head assembly senses rotational velocity of the screed head assembly about a lateral axis and/or a longitudinal axis of the screed head assembly. A control uses gyroscope sensor data and angle sensor data to determine pitch angle and/or roll angle of the screed head assembly. The control controls the screed head assembly based on the signals from one or both of the elevation sensors and the determined pitch and/or roll angles.

13 Claims, 4 Drawing Sheets

(56) References Cited

U.S. PATENT DOCUMENTS 4,930,935 A 6/1990 Quenzi et al.
4,978,246 A 12/1990 Quenzi et al.
5,039,249 A 8/1991 Hansen et al.
5,129,803 A 7/1992 Nomura et al.
5,156,487 A 10/1992 Haid
5,258,961 A 11/1993 Sehr et al.
5,288,166 A 2/1994 Allen et al.
5,288,167 A 2/1994 Gaffard et al.
5,328,295 A 7/1994 Allen
5,352,063 A 10/1994 Allen et al.
5,375,663 A 12/1994 Teach
5,401,115 A * 3/1995 Musil ..... E01C 19/008 404/72
5,540,518 A * 7/1996 Wambold ..... E01C 23/163 404/84.05
5,549,412 A 8/1996 Malone
5,556,226 A * 9/1996 Hohmann, Jr. ..... E01C 19/006 404/101
5,567,075 A 10/1996 Allen
5,588,776 A 12/1996 Swisher, Jr. et al.
5,752,783 A 5/1998 Malone
5,771,978 A 6/1998 Davidson et al.
6,027,282 A 2/2000 Horn
6,129,481 A 10/2000 Tapio et al.
6,152,647 A 11/2000 Tapio et al.
6,183,160 B1 2/2001 Tapio et al.
6,227,761 B1 5/2001 Kieranen et al.
6,530,720 B1 3/2003 Green
6,588,976 B2 7/2003 Quenzi et al.
6,623,208 B2 9/2003 Quenzi et al.
6,672,797 B1 * 1/2004 Zachman ..... E01C 19/004 404/120
6,752,567 B2 6/2004 Miyamoto et al.
6,846,128 B2 * 1/2005 Sick ..... E01C 19/004 404/133.05
6,953,304 B2 10/2005 Quenzi et al.
6,976,805 B2 12/2005 Quenzi et al.
7,044,681 B2 5/2006 Quenzi et al.
7,121,762 B2 10/2006 Quenzi et al.
7,175,363 B2 2/2007 Quenzi et al.
7,320,011 B2 1/2008 Quenzi et al.
7,320,558 B2 1/2008 Quenzi et al.
7,396,186 B2 7/2008 Quenzi et al.
7,491,011 B2 2/2009 Quenzi et al.
7,549,821 B2 * 6/2009 Hall ..... C04B 26/26 404/72
7,559,719 B2 7/2009 Nasby
7,677,834 B2 3/2010 Quenzi et al.
7,850,396 B2 12/2010 Pietila et al.
7,891,906 B2 2/2011 Quenzi et al.
7,909,533 B2 3/2011 Quenzi et al.
8,033,751 B2 * 10/2011 Yost ..... E01C 19/004 404/84.05
8,038,365 B2 10/2011 Quenzi et al.
8,068,962 B2 * 11/2011 Colvard ..... E01C 19/006 404/84.05
9,835,610 B2 12/2017 Kangas
10,147,040 B2 * 12/2018 Khurshudov ..... G05B 19/042
10,349,902 B2 * 7/2019 Girouard ..... A61B 5/746
2001/0048850 A1 12/2001 Quenzi et al.
2002/0098039 A1 7/2002 Kieranen et al.
2002/0127058 A1 * 9/2002 Zachman ..... E01C 19/006 404/84.5
2002/0154948 A1 * 10/2002 Brabec ..... E01C 19/004 404/75
2004/0071509 A1 4/2004 Frankeny
2004/0086337 A1 * 5/2004 Zachman ..... E01C 19/004 404/84.1
2004/0190991 A1 9/2004 Quenzi et al.
2005/0069385 A1 3/2005 Quenzi et al.
2006/0018715 A1 1/2006 Halonen et al.
2007/0116520 A1 5/2007 Quenzi et al.
2008/0109141 A1 5/2008 Nichols et al.
2009/0103978 A1 4/2009 Walker et al.
2010/0196096 A1 8/2010 Halonen et al.
2011/0085859 A1 4/2011 Yost
2012/0263532 A1 10/2012 Rutz et al.
2013/0124010 A1 * 5/2013 Olson ..... E01C 19/006 701/2
2016/0054283 A1 * 2/2016 Stromsoe ..... E02D 1/02 73/488
2018/0080184 A1 3/2018 Pietila et al.
2018/0375737 A1 * 12/2018 Wang ..... H04L 43/08
2019/0245864 A1 * 8/2019 Kulagin ..... H04L 9/0643

* cited by examiner

CONCRETE SCREEDING MACHINE WITH COLUMN BLOCK CONTROL USING GYRO SENSOR

CROSS REFERENCE TO RELATED APPLICATION

The present application claims the filing benefits of U.S. provisional application Ser. No. 62/599,809, filed Dec. 18, 2017, which is hereby incorporated herein by reference in its entirety.

FIELD OF THE INVENTION

The present invention relates generally to an apparatus and method for improving the operation of a concrete screeding machine during the leveling and smoothing of freshly poured concrete that has been placed over a surface.

BACKGROUND OF THE INVENTION

Screeding devices or machines are used to level and smooth uncured concrete to a desired grade. Known screeding machines typically include a screed head, which includes a vibrating member and a grade setting device, such as a plow or an auger device. The screed head is vertically adjustable, such as in response to a laser leveling system, to establish the desired grade at the vibrating member. Examples of such screeding machines are described in U.S. Pat. Nos. 4,655,633; 4,930,935; 6,227,761; 7,044,681; 7,175,363 and 7,396,186, which are hereby incorporated herein by reference in their entireties.

SUMMARY OF THE INVENTION

The present invention provides a screeding machine that determines, during a column block situation where one of two laser receivers is blocked, when and when not to rely on the angle sensor of the screed head in adjusting or controlling the screed head while screeding an uncured concrete surface. The system determines when and when not to rely on the angle sensor via processing of signals received from a gyro sensor of the screed head.

According to an aspect of the present invention, a screeding machine for screeding an uncured concrete surface comprises a screed head assembly movable over the concrete area, a pair of elevation sensors, such as laser receivers, disposed at opposite ends of the screed head assembly, an angle sensor disposed at the screed head assembly to sense a roll angle of the screed head assembly and/or a pitch angle of the screed head assembly, and a gyro sensor disposed at the screed head assembly to sense a pitch and/or roll rotational velocity of the screed head assembly. A control receives signals from the elevation sensors, the angle sensor, and the gyro sensor while the screeding machine is screeding the uncured concrete surface (optionally, the gyro sensor may be incorporated in the angle sensor device, whereby the control would receive angle sensor data that is processed with the gyro sensor data). The control, responsive to signals from the elevation sensors, controls the screed head assembly to set the grade of the uncured concrete. The control uses gyro sensor data and angle sensor data to determine the pitch angle and/or roll angle of the screed head assembly, and the control controls the screed head assembly based on the signals from one or both of the elevation sensors and the determined pitch and/or roll angles of the screed head assembly.

Responsive to one of the elevation sensors being blocked so as to not sense the elevation of its respective end of the screed head assembly, and responsive to processing of data sensed by the angle sensor and the gyro sensor, the control determines whether angle sensor data is compromised. Responsive to determination that the angle sensor data is compromised, the control controls the screed head assembly responsive to the signals from the unblocked elevation sensor and responsive to processing of the angle sensor data and the gyro sensor data (where the gyro sensor data is used to complement/correct/compensate the angle sensor data to determine a more accurate angle so that the determined angle can be used reliably in these column-block situations). Responsive to determination that the angle sensor data is not compromised (i.e., the gyro sensor indicates a rotational velocity that corresponds or correlates with the angle change determined by the angle sensor), the control controls the screed head assembly responsive to the signals from the unblocked elevation sensor and signals from the angle sensor. When the angle sensor data and the gyro sensor data indicate a change in angle, the gyro sensor data may be used to correct error in the angle sensor's angle determination (i.e., when the angle sensor indicates a greater change in angle than is associated with a rotational velocity determined by the gyro sensor, the gyro sensor data may be taken into account to correct the error in the angle sensor data).

The control determines the signals from the angle sensor are compromised (such that the angle sensor is not properly or accurately sensing the angle of the screed head assembly) responsive to (i) the angle sensor data being indicative of an angle change and (ii) the gyro sensor data being indicative of little or no change in rotational velocity of the screed head assembly (such as any determined change in rotational velocity being below a threshold level), or responsive to (i) the angle sensor data being indicative of an angle change and (ii) the gyro sensor data being indicative of a rotational velocity representative or associated with an angle change that does not correspond or correlate with the angle change determined by processing angle sensor data. Likewise, the control determines the angle sensor data is not compromised (and thus is considered to be properly or accurately sensing the angle of the screed head assembly) responsive to (i) the angle sensor data being indicative of an angle change and (ii) the gyro sensor data being indicative of a change in rotational velocity of the screed head assembly that corresponds or correlates with the angle change determined by processing angle sensor data.

These and other objects, advantages, purposes and features of the present invention will become apparent upon review of the following specification in conjunction with the drawings.

DESCRIPTION OF THE PREFERRED EMBODIMENTS

Figure 1:
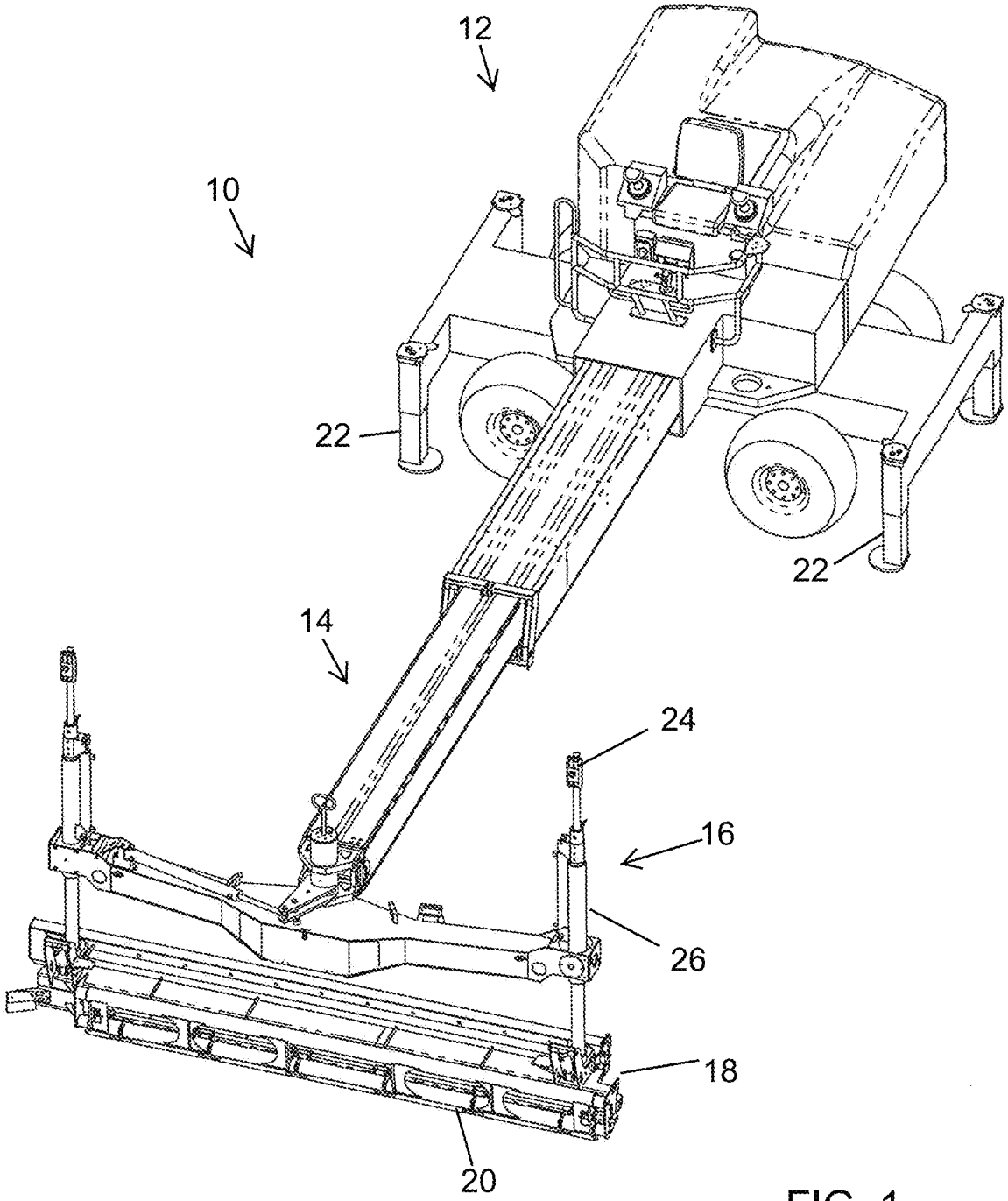
FIG. 1 is a perspective view of a concrete leveling and screeding machine of the present invention.

Referring now to the drawings and the illustrative embodiments depicted therein, a screeding machine 10 includes a base unit 12 (which may comprise a wheeled unit as shown in FIG. 1 or may comprise any other form of base unit or structure) with a boom 14 extending therefrom and supporting a screeding head or assembly 16 at an outer end thereof (FIG. 1). The base unit 12 is movable or drivable to a targeted area at a support surface with uncured concrete placed thereat, and the base unit may include an upper portion that rotates about a base portion to swing the boom and screeding head to a targeted location. The boom 14 is extendable and retractable to move the screeding head 16 over the placed concrete, while the screeding head 16 is operable to establish a desired grade of the concrete surface and smooth or finish or screed the concrete. In the illustrated embodiment, the screeding head includes a grade setting device or plow or auger 18 and a vibrating member 20. The screeding machine includes a plurality of stabilizers 22, which may be extendable and retractable, to support and stabilize the machine on the support surface during the screeding operation. The controller of the screeding machine individually controls the elevation cylinders 26 of the screed head responsive to signals generated by the laser receivers 24, which sense a laser reference plane generated at the work site.

Screeding machine 10 and the screeding head or assembly 16 may be similar in construction and/or operation as the screeding machines and screeding heads described in U.S. Pat. Nos. 4,655,633; 4,930,935; 6,227,761; 7,044,681; 7,175,363; 7,396,186 and/or 9,835,610, and/or U.S. Publication Nos. US-2007-0116520 and/or US-2010-0196096, which are all hereby incorporated herein by reference in their entireties, such that a detailed discussion of the overall construction and operation of the screeding machines and screeding heads need not be repeated herein. However, aspects of the present invention are suitable for use on other types of screeding machines. For example, the screeding head of the present invention may be suitable for use on a smaller screeding machine, such as a machine of the types described in U.S. Pat. Nos. 6,976,805; 7,121,762 and/or 7,850,396, which are hereby incorporated herein by reference in their entireties. Optionally, the screeding head may be used on other types of screeding machines, such as a screeding machine with the screeding head mounted at an articulatable boom, such as of the types described in U.S. Publication No. US-2018-0080184, which is hereby incorporated herein by reference in its entirety.

Figure 5:
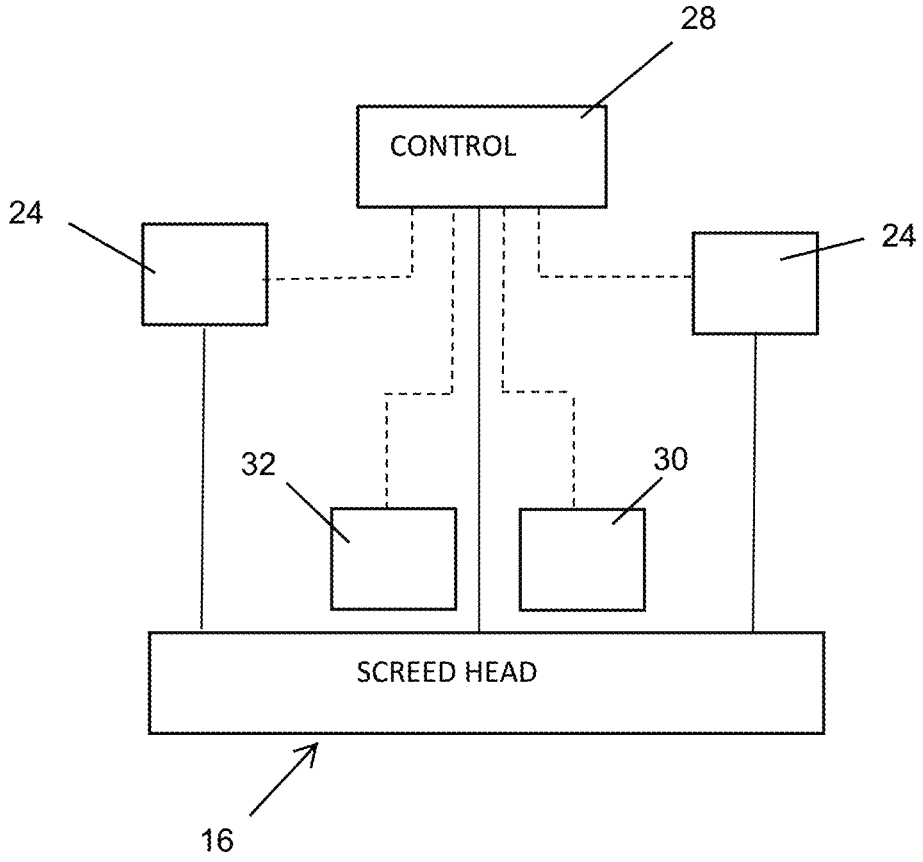
FIG. 5 is a block diagram showing the sensors and controller of the screeding machine and system of the present invention.
Figure 6:
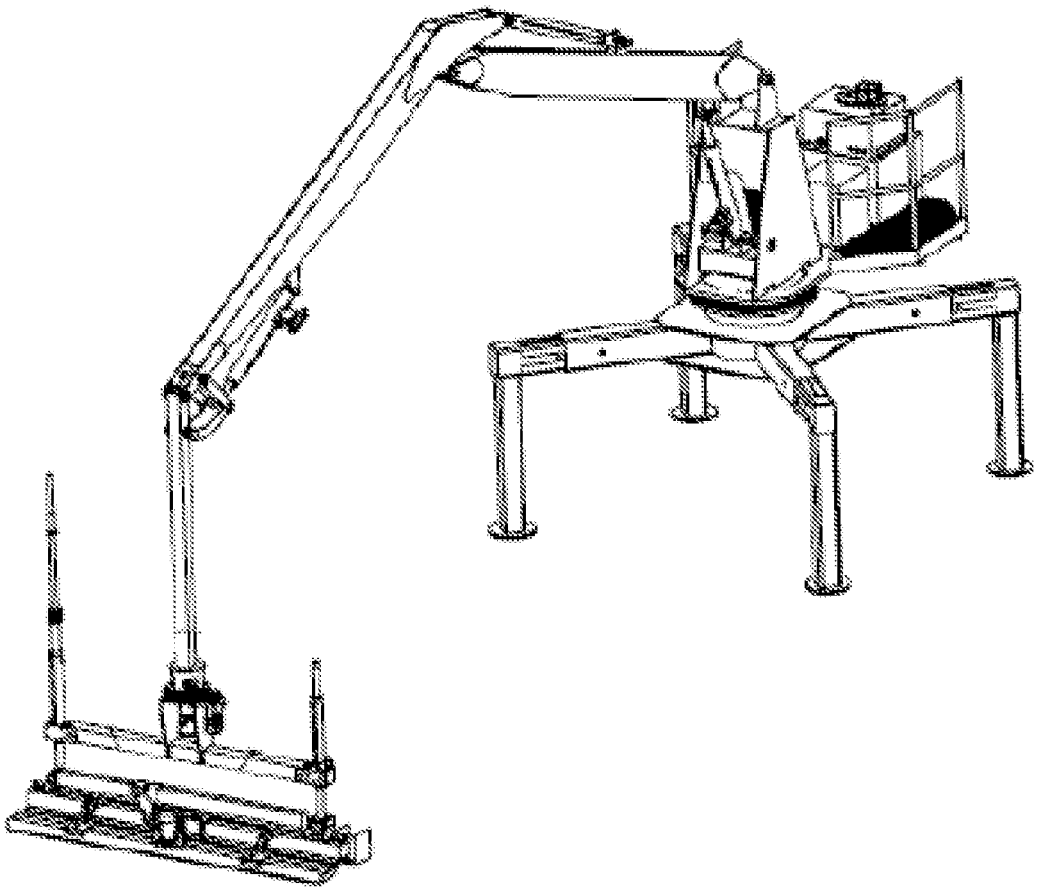
FIG. 6 is a perspective view of a screeding machine that comprises a screed head assembly movable relative to the base unit via an articulating boom.

As shown in FIG. 5, the system and screeding machine includes a control 28, which receives data or signals from the laser receivers 24 and from an angle sensor 30 and a gyroscope sensor 32. The control, responsive to signals from the elevation sensors or laser receivers (such as responsive to processing of elevation sensor data captured by the elevation sensors and provided to a data processor of the control), controls the screed head assembly to set the grade of the uncured concrete. The control uses gyro sensor data (captured by the gyroscope sensor 32 and provided to and processed at a data processor of the control) and angle sensor data (captured by the angle sensor 30 and provided to and processed at a data processor of the control) to determine the pitch angle and/or roll angle of the screed head assembly. The control controls the screed head assembly based on the signals from one or both of the elevation sensors and the determined pitch and/or roll angles of the screed head assembly. The control individually controls the elevation cylinders 26 of the screed head assembly 16 to individually adjust the height of the respective side of the screed head. The elevation cylinders are controlled responsive to the laser receivers (that detect a laser plane generated at the screeding site whereby adjustment of the elevation cylinders moves the screed head end and the respective laser receiver relative to the laser plane to locate the laser plane at a target location at the laser receiver) and/or responsive to only one of the laser receivers (such as during a column block situation) and the angle sensor and gyroscope sensor and/or responsive to both laser receivers and the angle sensor and gyroscope sensor.

Figure 2:
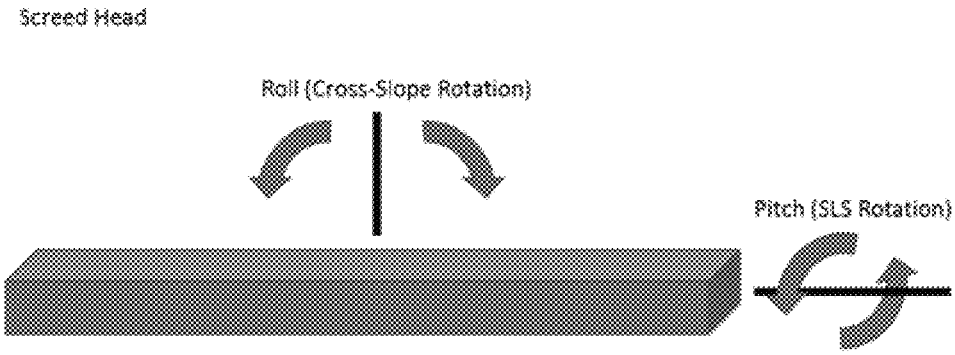
FIG. 2 is a schematic of a screed head, showing angles that may be sensed by a two-axis angle sensor of the screed head.
Figure 3:
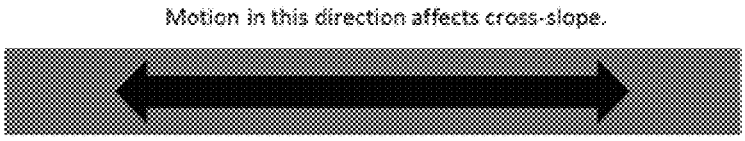
FIG. 3 is another schematic of the screed head, showing lateral motion that affects the angle sensor's ability to sense roll angles of the screed head.
Figure 4:
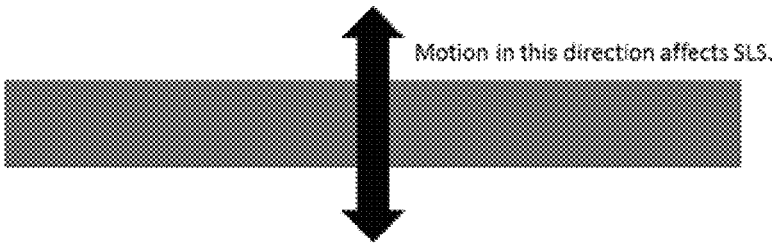
FIG. 4 is another schematic of the screed head, showing motion that affects the angle sensor's ability to sense pitch angles of the screed head.

The screeding machine relies on data to accurately control pitch and roll of the screed head (including the grade setting element or plow and the vibrating member). The data is provided from an angle sensor or sensors. As shown in FIG. 2, roll is a cross-slope axis angle of the screed head. A cross-slope control may control the screed head elevation if one of the laser receivers become blocked. As also shown in FIG. 2, pitch is the fore/aft tilt of the screed head about its longitudinal axis. An SLS (Self Level System) axis control controls the head angle of attack so that the cutting edge or edges and the vibrator contact the concrete consistently to accurately cut grade and provide the desired final surface finish and/or appearance. Angle sensor readings are accurate in static situations and in situations with constant velocity.

Changes in direction or changes in speed will affect the angle sensor data. This results in incorrect angle data which will cause the control system to control Cross-Slope and/or SLS at the wrong angle. With Cross-Slope errors, the cutting edge will either cut too low or raise up cutting the material too high. With SLS errors, the cutting edge and vibrator will control to the wrong angle causing an incorrect floor height and/or poor surface finish.

This occurs because the known device is an angle sensor that only senses the angle of the screed head relative to a horizontal plane and responsive to gravity. Each axis of the angle sensor is independent and responsible for either cross-slope data or SLS data. The sensor provides the angle of the axis by using gravity to determine how far out of level the sensor is at any given time. Changes in direction or speed of screed head travel cause the system (due to changes in acceleration), responsive to processing of angle sensor data, to erroneously determine or conclude that the angle of the screed head has changed. The sensor and the system do not recognize that a change in motion (speed and/or direction) has occurred, and thus it reports an angle that is incorrect.

The SLS axis data can be filtered to ignore large changes in angle. This helps hide the issue, but it results in slower system response to real angle changes.

The issue with the Cross-Slope data is more difficult to handle. Motion in the cross-slope axis occurs more frequently with starts and stops and changes in direction. If the system relies on the angle sensor data (sensed via the angle sensor or accelerometer), the material will be cut at the wrong height whenever such motion is occurring. Through training, operators are often instructed to not cause motion in that axis if the angle sensor is being used (e.g., if one of the laser receivers is blocked). In addition to this, the angle sensor data may be completely ignored when motion in that axis is occurring to avoid cutting the grade at the wrong height. In these situations, the unblocked laser receiver is used to control elevation at the unblocked side and at the blocked side.

If a sensor can provide valid angular data during start or stop situations and when changing direction or speeds it would solve the issues for SLS and Cross-Slope. SLS control would be improved. Cross-slope control could be utilized even when such motion is present.

The angle sensor is needed for reference for true angle of the screed head. The system of the present invention provides an additional sensor and method to keep the angle sensor in check when changes in speed or motion occur. The addition of a gyroscope (gyro) sensor, which detects angular or rotational velocity about one or both of the two orthogonal axes of the screed head, may be used for stabilizing the angle sensing and determining when its sensed data is valid or compromised or erroneous. Using accelerometer sensor data and gyro sensor data allows the data to be processed without the issues of using only an angle (accelerometer) sensor.

The gyro sensor may include the angle sensing function, such that the output of the device is still data pertaining to an angle, but without the issues inherent in only accelerometer angle sensors. Optionally, the sensor may comprise an Inertial Measurement Unit (IMU) and may provide the raw accelerometer data ($m/s^2$) and raw gyro data (degrees/second), which then requires data processing by a secondary controller of the screed head or machine.

The gyro sensor measures rotational velocity of the screed head about one or both of the two axes of the screed head (across the screed head and/or fore-aft of the screed head). If lateral movement, a start/stop, a change in speed, and/or a change in direction of the screed head occurs, the angle sensor data would include a spike or increase (even though the angle of the screed head may not change) while the rotational velocity of the screed head (as sensed by the gyro sensor) will remain low or near zero (below a threshold value) if the angle does not actually change. Therefore, the angle sensor reading that is affected by the acceleration(s) can be compensated by the gyro sensor data (so that the system can ignore the spikes or changes detected by the angle sensor in those situations). The data processing determines that, because the rotational velocity (as determined by the gyro sensor data) was very low or zero, and the acceleration data (as sensed by the angle sensor) spiked, the acceleration was caused by lateral motion (or change in speed, etc.) and not a true rotation or angle change of the screed head. The angle (as sensed by the angle sensor) thus would not have actually changed, and thus no correction due to the "sensed angle" would be needed. In other words, when the gyro sensor determines that there is little or no rotational velocity, the system may utilize the gyro sensor data to correct the erroneous angle sensor data, such that the system may control a blocked end of the screed head via signals from the unblocked laser receiver and from the corrected angle sensor data (as corrected or compensated via processing of the angle sensor data with the gyro sensor data). Likewise, when the angle sensor senses a change in angle, and the gyro sensor senses a change in rotational velocity, the system may determine whether the signal from the angle sensor is valid or not compromised by lateral movement or the like (via determining whether or not the detected change in rotational velocity correlates with the detected change in angle), and, if the sensor data correlate, the system may control a blocked end of the screed head via signals from the unblocked laser receiver and from the angle sensor. Alternatively, if the angle sensor data does not correspond or correlate with the gyro sensor data, the system may utilize the gyro sensor data (via processing the gyro sensor data and angle sensor data) to correct or compensate the erroneous angle sensor data to provide or determine the correct angle of the screed head at any given time during the screed pass.

The system thus not only uses the gyro sensor data to determine when the angle sensor data is compromised, but also uses the gyro sensor data to correct the angle sensor reading so that even with lateral motion or other changes in direction or speed of the screed head (and thus compromised angle sensor data) the determined angle (via processing of the angle sensor data and gyro sensor data) is valid and can be relied on. The system thus can still use the angle sensor for controlling the end of the screed head with the blocked laser receiver, but the data would be corrected by the gyro sensor data, so as to provide more accurate control of the screed head at all times when one of the laser receivers is blocked or compromised. The gyro sensor data thus is used to compensate for the lateral motion or other motions or accelerations so that the screed head angle provided to or determined by the system can still be relied upon. The system thus can account for blocking at a laser receiver to control the blocked end responsive to the angle sensor and the gyro sensor versus having to control the blocked end using only signals from the unblocked laser receiver, which is less accurate.

The SLS axis controls the angle of attack of the screed head regardless of whether an elevation sensor is blocked/compromised or not. Thus, the control may use the angle sensor data and the gyro sensor data to more accurately determine changes in the angle of attack of the screed head in all screeding situations. The cross-slope axis assists elevation control when a receiver (elevation sensor) is blocked, and the control may use the angle sensor data and gyro sensor data to accurately determine changes in the cross-slope particularly when one of the elevation sensors is blocked.

During typical screeding passes, the machine makes corrections of the elevation of the screed head at either end based on signals from the respective laser receivers. When one of the laser receivers is blocked or compromised (and thus may not receive the laser plane reference signal), the system does not know how much to adjust/correct the blocked end or side of the screed head. The machine or system uses a gyro sensor to determine if the angle sensor signal or data is valid or accurate, or if its signal or data is compromised or not reliable by itself (due to changes in acceleration of the screed head, such as if there is lateral movement of the screed head that causes erroneous signals from the angle sensor). The control or system continually reads or receives signals or data sensed by the angle sensor and the gyro sensor to more accurately determine the screed head angle and to more accurately adjust a blocked side responsive to the signals from the angle sensor and the unblocked laser receiver. When the signal is not compromised, the angle sensor data is used with the unblocked laser receiver signals to control the blocked end of the screed head. When the angle sensor signal is compromised or is providing erroneous angle determinations, the angle sensor data is adapted or corrected responsive to processing of the gyro sensor data (in conjunction with processing of the angle sensor data), whereby the adapted or corrected determined angle information is used with the unblocked laser receiver signals to control the blocked end of the screed head.

The system thus can readily determine the angle of the screed head and thus the proper adjustment of a blocked end of the screed head during a screeding pass. When lateral movements or forces are introduced, the system can determine that such movements are present (via processing of gyro sensor data) and can correct the erroneous angle sensor data accordingly. The resulting or corrected angle measurement is then used in conjunction with the laser receiver signal or data to properly set or adjust the screed head during the screeding pass.

As discussed above, during normal operation of the screeding machine, the angle sensor works well when doing a straight pass (when there are no lateral movements or accelerations or rotational movements or accelerations). Once a different movement occurs, the angle sensor senses changes in acceleration and thus its signals cannot be trusted. The machine or system of the present invention corrects for this by determining when the angle sensor is not to be trusted (e.g., when there is side-to-side change or other accelerations or movements of the screed head) and then uses the gyro sensor data to correct the angle reading. When the angle sensor generates signals indicative of changes in angle(s), and the gyro sensor does not sense any changes in rotational velocity of the screed head, then the system can determine that there is sideward movement of the screed head (or other acceleration of the screed head) and possibly no actual change in angles, and the system will not react to the angle sensor bad data but continue to control the screed head properly based on the laser receiver signal (and/or the corrected angle sensor data). Also, when the angle sensor generates signals indicative of changes in angle(s), and the gyro sensor senses changes in rotational velocity of the screed head, then the system can determine that there are angular changes of the screed head and can determine how much of the angle sensor data is attributed to lateral accelerations (via processing of the angle sensor data and gyro sensor data) and can adjust or correct the angle determination (via processing of the angle sensor data and gyro sensor data), whereby and the system can then use the signals from the unblocked laser receiver and/or the corrected angle determination to adjust the ends of the screed head.

The gyro sensor may be part of the angle sensor or may be a separate sensor at the screed head. The sensors work together so that the system can determine when there is lateral motion of the screed head and can determine the actual angle change of the screed head during various movements of the screed head during a screeding pass. More particularly, the gyro sensor can be used to determine when changes in angle sensor signals or data are at least in part due to lateral movement (when the angle sensor signal changes, and the gyro sensor does not indicate a rotational velocity change that would correspond to the determined angle change), whereby the system can process the angle sensor data and the gyro sensor data together to determine the actual change in angle of the screed head. The system thus can adjust the calculated or determined angle accordingly so that it is accurate and reliable, even when there are lateral movements or the like of the screed head during a screeding pass.

The control of the screeding machine thus may receive signals from the laser receivers, the angle sensor and the gyro sensor and may process the angle sensor data and gyro sensor data to determine or calculate the actual or accurate change in angle and current angle of the screed head assembly. Optionally, the angle sensor and gyro sensor may be part of a single sensing device at the screed head assembly, where the single sensing device may include a processor that processes angle sensor data and gyro sensor data to determine or calculate an actual or accurate change in angle of the screed head assembly, whereby a single output indicative of the corrected or accurate angle of the screed head is communicated to the control of the screed head for use in adjusting the elevation cylinders during a screeding pass.

Thus, the system or machine or method for screeding an uncured concrete surface includes a screeding machine comprising a screed head assembly, a pair of elevation sensors disposed at opposite ends of the screed head assembly, an angle sensor disposed at the screed head assembly, a gyroscope sensor disposed at the screed head assembly, and a control. The screed head assembly is moved over the concrete surface via the screeding machine to screed the concrete surface. The elevation sensors sense an elevation of the respective end of the screed head assembly relative to a reference plane established at the concrete surface, and elevation sensor data (indicative of the sensed elevation) is provided to the control for processing to determine the elevation of the respective end of the screed head assembly. The angle sensor senses a pitch angle of the screed head assembly and/or a roll angle of the screed head assembly, and angle sensor data (indicative of the sensed pitch and/or roll angle) is provided to the control for processing to determine the pitch and/or roll angle of the screed head assembly. The gyroscope sensor senses rotational velocity of the screed head assembly about a lateral axis of the screed head assembly and/or a longitudinal axis of the screed head assembly, and gyroscope sensor data (indicative of the sensed rotational velocity) is provided to the control for processing to determine the rotational velocity of the screed head assembly. The control, responsive at least in part to the elevation sensor data from the elevation sensors, controls the screed head assembly to set the grade of the uncured concrete. The control determines the pitch angle and/or roll angle of the screed head assembly based at least in part on (i) the rotational velocity sensed by the gyroscope sensor and/or (ii) the pitch angle and/or roll angle sensed by the angle sensor. The control controls the screed head assembly based on (i) the elevation of the respective end of the screed head assembly sensed by one or both of the elevation sensors, (ii) the rotational velocity sensed by the gyroscope sensor and (iii) the pitch angle and/or roll angle sensed by the angle sensor.

The system or machine or method determines when one of the elevation sensors is not properly sensing the elevation of the respective end of the screed head assembly (such as due to a column blocking situation or the like), and determines whether or not the angle sensor is properly sensing the pitch angle and/or roll angle of the screed head assembly. Responsive to determining that one of the elevation sensors is compromised and responsive to determining that the angle sensor is not properly sensing the pitch angle and/or roll angle of the screed head assembly, the control controls the screed head assembly based on (i) the elevation of the respective end of the screed head assembly sensed by the other (unblocked or not compromised) elevation sensor and (ii) the rotational velocity sensed by the gyroscope sensor. Responsive to determining that one of the elevation sensors is not properly sensing the elevation of the respective end of the screed head assembly, and when there is no determination that the angle sensor is not properly sensing the pitch angle and/or roll angle of the screed head assembly, the control controls the screed head assembly responsive to the signals from the other (unblocked or not compromised) elevation sensor and the determined pitch angle and/or roll angle as determined via processing of angle sensor data captured by the angle sensor and provided to the control.

The determination that the angle sensor is not properly sensing the pitch angle and/or roll angle of the screed head assembly may comprise determination that (i) the angle sensor data is indicative of an angle change and (ii) the gyroscope sensor data is indicative of a change in rotational velocity of the screed head assembly that is below a threshold level, or may comprise determination that (i) the angle sensor data is indicative of an angle change and (ii) the gyroscope sensor data is indicative of a change in rotational velocity of the screed head assembly that does not correlate with the angle change indicated by the angle sensor data. The determination that the angle sensor is properly sensing the pitch angle and/or roll angle of the screed head assembly may comprise determination that (i) the angle sensor data is indicative of an angle change and (ii) the gyroscope sensor data is indicative of a change in rotational velocity of the screed head assembly that correlates with the angle change indicated by the angle sensor data.

Changes and modifications to the specifically described embodiments can be carried out without departing from the principles of the present invention, which is intended to be limited only by the scope of the appended claims as interpreted according to the principles of patent law.

The invention claimed is:

1. A screeding machine for screeding an uncured concrete surface, said screeding machine comprising:

a screed head assembly comprising a grade setting device and a vibrating member, wherein said screed head assembly is movable over the concrete surface via said screeding machine;

a pair of elevation sensors disposed at opposite ends of said screed head assembly, wherein said elevation sensors sense an elevation of the respective end of said screed head assembly relative to a reference plane established at the concrete surface;

an angle sensor disposed at said screed head assembly, wherein said angle sensor senses a pitch angle of said screed head assembly and/or a roll angle of said screed head assembly, and wherein said angle sensor captures angle sensor data indicative of the sensed pitch angle and/or roll angle;

a gyroscope sensor disposed at said screed head assembly, wherein said gyroscope sensor senses rotational velocity of said screed head assembly about a lateral axis of said screed head assembly and/or a longitudinal axis of said screed head assembly, and wherein said gyroscope sensor captures gyroscope sensor data indicative of the sensed rotational velocity;

a control, wherein said control, responsive to signals from said elevation sensors, controls said screed head assembly to set the grade of the uncured concrete;

wherein said control processes gyroscope sensor data and angle sensor data to determine the pitch angle and/or roll angle of the screed head assembly, and wherein said control controls the screed head assembly based on signals from one or both of said elevation sensors and the determined pitch angle and/or roll angle of the screed head assembly;

wherein, responsive to one of said elevation sensors being compromised so as to not properly sense the elevation of its respective end of said screed head assembly, and via processing of angle sensor data captured by said angle sensor and gyroscope sensor data captured by said gyroscope sensor, said control determines whether the angle sensor data is compromised; and wherein, responsive to the one of said elevation sensors being compromised and responsive to determination that the angle sensor data is compromised, said control processes the gyroscope sensor data to determine the pitch angle and/or roll angle of the screed head assembly, whereby said control controls the screed head assembly based on the signal from an uncompromised elevation sensor of said elevation sensors and based on the pitch angle and/or roll angle of the screed head assembly determined using the gyroscope sensor data.

2. The screeding machine of claim 1, wherein said screeding machine comprises a wheeled unit, and wherein said screed head assembly is movable relative to said wheeled unit via an extendable and retractable boom.

3. The screeding machine of claim 1, wherein said screeding machine comprises a wheeled unit with said screed head assembly adjustably mounted thereat, and wherein said screed head assembly is movable over the concrete via movement of said wheeled unit over and through the uncured concrete.

4. The screeding machine of claim 1, wherein said screeding machine comprises a base unit and wherein said screed head assembly is movable relative to said base unit via an articulating boom.

5. The screeding machine of claim 1, wherein said elevation sensors comprise laser receivers.

6. The screeding machine of claim 1, wherein, responsive to determination that the angle sensor data is not compromised, said control controls said screed head assembly responsive to signals from the uncompromised elevation sensor and the determined pitch angle and/or roll angle as determined via processing of angle sensor data.

7. The screeding machine of claim 1, wherein said control determines the angle sensor data is compromised responsive to (i) the angle sensor data being indicative of an angle change and (ii) the gyroscope sensor data being indicative of a change in rotational velocity of said screed head assembly that is below a threshold level, or responsive to (i) the angle sensor data being indicative of an angle change and (ii) the gyroscope sensor data being indicative of a change in rotational velocity of said screed head assembly that does not correlate with the angle change indicated by the angle sensor data.

8. The screeding machine of claim 7, wherein said control determines the angle sensor data is not compromised responsive to (i) the angle sensor data being indicative of an angle change and (ii) the gyroscope sensor data being indicative of a change in rotational velocity of said screed head assembly that correlates with the angle change indicated by the angle sensor data.

9. The screeding machine of claim 1, wherein said angle sensor comprises a one or two-axis sensor that senses the pitch angle of said screed head assembly and/or the roll angle of said screed head assembly.

10. The screeding machine of claim 1, wherein said control receives the angle sensor data and the gyroscope sensor data and processes the angle sensor data and the gyroscope sensor data to determine a corrected angle of said screed head assembly.

11. The screeding machine of claim 1, wherein a processor at said screed head assembly receives the angle sensor data and the gyroscope sensor data and processes the angle sensor data and the gyroscope sensor data to determine a corrected angle of said screed head assembly, and wherein the processor generates an output to said control that is representative of the corrected angle of said screed head assembly.

12. The screeding machine of claim 1, wherein, in situations where one of said elevation sensors is blocked so as to not properly sense the elevation of its respective end of said screed head assembly and where said angle sensor is not compromised, said control controls the screed head assembly based on the elevation sensed by the unblocked elevation sensor and the pitch angle and/or roll angle sensed by said angle sensor.

13. The screeding machine of claim 12, wherein, in situations where one of said elevation sensors is blocked so as to not properly sense the elevation of its respective end of said screed head assembly and where said angle sensor is compromised so as to not properly sense the pitch angle and/or roll angle of said screed head assembly, said control controls the screed head assembly based on the elevation sensed by the unblocked elevation sensor and the rotational velocity sensed by said gyroscope sensor.

* * * * *